US008061911B2

(12) United States Patent
Saida

(10) Patent No.: US 8,061,911 B2
(45) Date of Patent: Nov. 22, 2011

(54) IMAGE FORMING APPARATUS WITH CONTROLLER FOR CONTROLLING USE OF DIFFERENT PRINT MEDIA

(75) Inventor: Yukihiro Saida, Tokyo (JP)

(73) Assignee: Oki Data Corporation, Tokyo (JP)

( * ) Notice: Subject to any disclaimer, the term of this patent is extended or adjusted under 35 U.S.C. 154(b) by 49 days.

(21) Appl. No.: 11/230,892

(22) Filed: Sep. 21, 2005

(65) Prior Publication Data

US 2006/0062621 A1 Mar. 23, 2006

(30) Foreign Application Priority Data

Sep. 22, 2004 (JP) ..... 2004-274881

(51) Int. Cl.
*B65H 7/04* (2006.01)
*B65H 3/44* (2006.01)

(52) U.S. Cl. ..... 400/76; 399/23

(58) Field of Classification Search ..... 400/582, 400/605, 76, 624, 629; 271/9.01–9.04; 399/16, 399/23, 393

See application file for complete search history.

(56) References Cited

U.S. PATENT DOCUMENTS

| | | | | |
|---|---|---|---|---|
| 5,130,757 | A | 7/1992 | Ito | |
| 5,168,316 | A * | 12/1992 | Hino et al. | 399/23 |
| 5,289,236 | A * | 2/1994 | Yoshino | 399/86 |
| 6,125,242 | A * | 9/2000 | Yamada | 399/23 |
| 6,285,843 | B1 | 9/2001 | Obata | |
| 6,810,219 | B2 * | 10/2004 | Yokobori et al. | 399/45 |
| 7,355,733 | B2 * | 4/2008 | Sommer et al. | 358/1.15 |
| 2001/0007619 | A1 * | 7/2001 | Kakutani | 400/582 |
| 2001/0017989 | A1 * | 8/2001 | Tamai et al. | 399/16 |
| 2002/0024575 | A1 | 2/2002 | Sato | |
| 2002/0044809 | A1 * | 4/2002 | Hayashi et al. | 399/391 |
| 2004/0141762 | A1 | 7/2004 | Okamoto et al. | |

FOREIGN PATENT DOCUMENTS

| | | | |
|---|---|---|---|
| JP | 10-129072 | | 5/1998 |
| JP | 2000-143017 | | 5/2000 |
| JP | 2001018494 | A * | 1/2001 |
| JP | 2002205837 | A * | 7/2002 |

OTHER PUBLICATIONS

Machine translation of JP 2002205837 to Saito et al. from Japanese Patent Office website, Jul. 2002.*

* cited by examiner

*Primary Examiner* — Daniel J Colilla
(74) *Attorney, Agent, or Firm* — Rabin & Berdo, P.C.

(57) ABSTRACT

An image forming apparatus used for displaying print media information according to print data and selecting designated print media to print from kinds of print media, comprises a receiving section for receiving print data, a judging section for judging whether first print media has been designated by the print media information, a print media setting input section for being inputted print media setup information so as to set second print media when getting a judging result that first print media having being designated, a controller for forming image on the second print media indicated by the setup information of the print media according to the above print data when the described print media setting input section is inputted the print media setup information, and an informing section for urging to supply the second print media once detecting lack of the second print media during image forming of the controller.

7 Claims, 12 Drawing Sheets

| Item | Value |
|---|---|
| PAPER SIZE | A4 |
| | LETTER |
| | LEGAL13 |
| | : |
| | CUSTOM |
| MEDIA TYPE | PLAIN |
| | LETTERHEAD |
| | RECYCLED |
| | : |
| | TRANSPARENCY |
| MEDIA WEIGHT | LIGHT |
| | MEDIUM |
| | HEAVY |
| | ULTRA HEAVY |

FIG. 5

(UNIT :mm)

| PRINT MEDIA TYPE | LENGTH | Min | Min | PRINT MEDIA ID |
|---|---|---|---|---|
| A 6 | 148 | 143 | 153 | 1 |
| Monarch | 191 | 186 | 196 | 2 |
| A 5 | 210 | 205 | 215 | 3 |
| Com-9 | 225 | 220 | 230 | 4 |
| Com-10 | 241 | 236 | 246 | 5 |
| Executive | 267 | 262 | 272 | 6 |
| Letter | 279 | 274 | 284 | 7 |
| A 4 | 297 | 292 | 302 | 8 |
| Lega113 | 330 | 325 | 335 | 9 |
| Lega113.5 | 343 | 338 | 348 | 10 |
| Leag114 | 356 | 351 | 361 | 11 |
| A 3 | 420 | 415 | 425 | 12 |
| Tabloid | 432 | 427 | 437 | 13 |
| Tabloid Extra | 457 | 452 | 462 | 14 |
| OTHER | – | – | – | 0 |

FIG. 9

IMAGE FORMING APPARATUS WITH CONTROLLER FOR CONTROLLING USE OF DIFFERENT PRINT MEDIA

BACKGROUND OF THE INVENTION

1. Field of the Invention

The present invention relates to an image forming apparatus such as a digital photo printer, a duplicating machine, an electrograph and so on, and more particularly to an image forming apparatus which provides plurality of cassettes (paper feeder) for being set print media.

2. Description of the Related Art

A conventional printer connected to upper apparatus such as a main computer usually includes a plurality of paper cassettes. Print media information, such as different types, sizes or color paper, is saved in the paper cassettes in advance. The conventional printer selects the paper cassette to feed paper according to the print media information transmitted from the upper apparatus and prints on the anticipant print media. If there is no print media in the paper cassettes, the conventional printer automatically switch to select other paper cassettes to feed paper.

As disclosed in Official Gazette of Japanese Patent Application Laid-Open No. 2000-143017, the conventional printer provides plurality of paper feeding trays. If there is no paper in a selected paper feeding tray when feeding paper, the other tray with same paper information (size, kind) of the selected tray is automatically switched to feed paper. In this case, if there is no tray having same paper information with the selected paper feeding tray, print error of the selected tray with no paper is displayed and the print processing is paused. If there is no tray that contains matched paper information with that of the upper apparatus, the printer designates the tray contains inconsistent paper information to feed paper and executes printing forcibly (continue print mode).

However, when the conventional printer performs continue print job, if the print media of the selected paper feeding tray is used up, the paper feeding system will automatically switch to other trays. Because the other trays may be of different paper information with that of the selected paper feeding tray, the print job may be printed on the unexpected print media.

SUMMARY OF THE INVENTION

The invention is made in consideration of the above problems and it is an object of the invention to provide a printing apparatus having a plurality of paper feeding trays. When print media is consumed in continue print processing, the printing apparatus urges to shift paper feeding tray so as to print image on expected print media.

In order to obtain above object, the invention provides following preferable configuration.

In accordance with a first aspect of the invention, an image forming apparatus used for displaying print media information according to print data and selecting designated print media to print, the image forming apparatus comprises a receiving section for receiving print data, a judging section for judging whether first print media has been designated by the print media information, a print media setting input section for being inputted print media setup information so as to designate second print media when getting a judging result that first print media having been designated, a controller for forming image on the second print media indicated by the setup information of the print media according to the above print data when the described print media setting input section is inputted the print media setup information, and an informing section for urging to supply the second print media once detecting lack of the second print media during image forming of the controller.

Other objects, advantages and novel features of the invention will become more apparent from the following detailed description when taken in conjunction with the accompanying drawings.

BRIEF DESCRIPTION OF THE DRAWING

FIG. 5 is a schematic view showing setup item of print media;

FIG. 9 is a schematic view showing an example of comparing watch of paper size;

DETAILED DESCRIPTION OF THE INVENTION

First Embodiment

Figure 1:
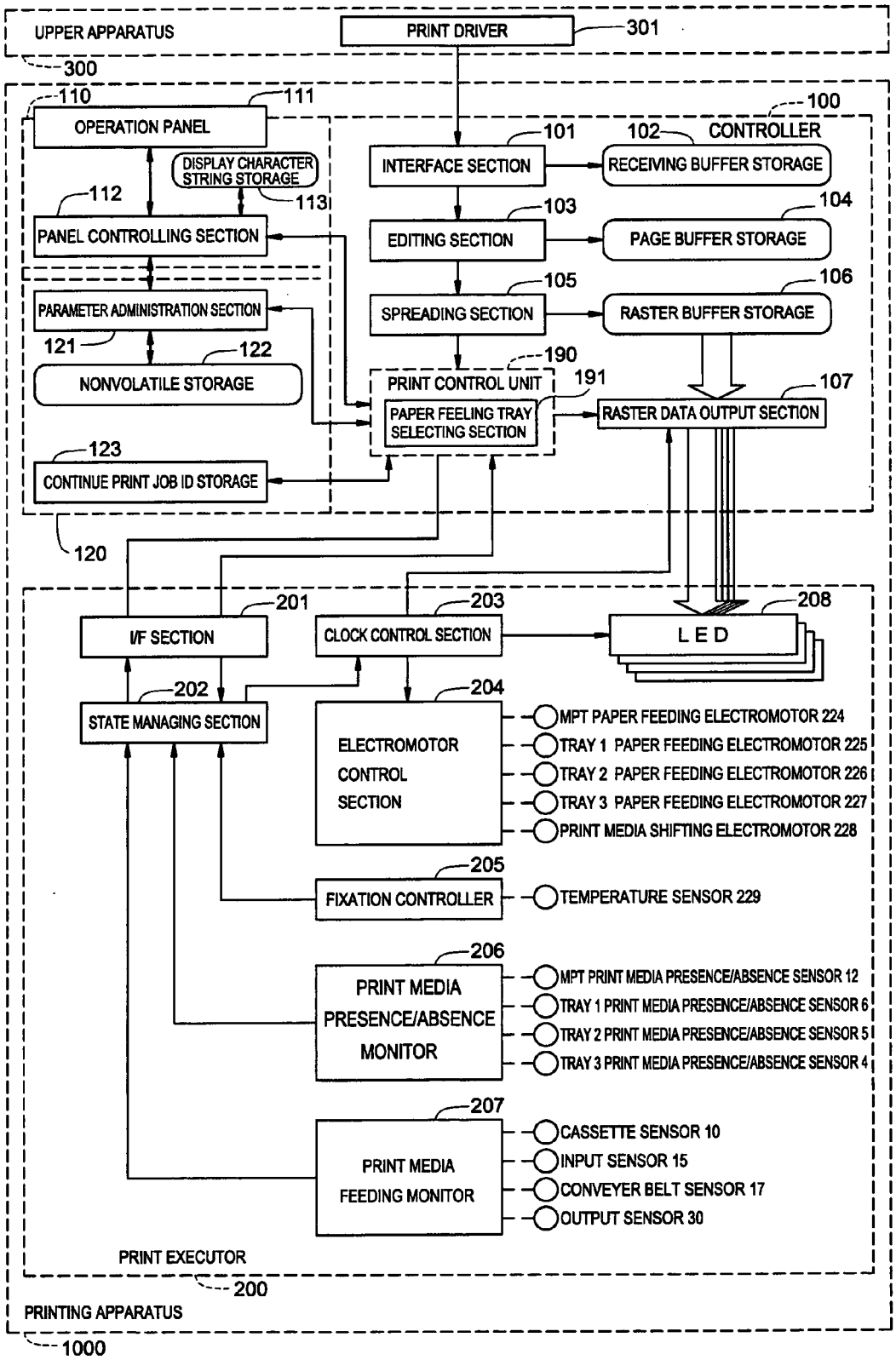
FIG. 1 is a block diagram showing a digital photo printing apparatus according to a first embodiment of the present invention.

As shown in FIG. 1, a digital photo printing apparatus 1000 according to a first embodiment in the present invention is connected to an upper apparatus 300, and includes a print executor 200 for printing and a controller 100. The controller 100 controls the print executor 200 according to print data and designated print media information generated from the upper apparatus 300, as will be discussed hereinafter. The controller 100 is connected with the upper apparatus 300 such as a workstation or a PC (Personal Computer). The upper apparatus 300 includes a print driver 301 for transmit the print data to the controller 100.

The controller 100 comprises an interface section 101 (receiving section) for receiving the print data from the print driver 301, a receiving buffer storage 102 for storing the print data received by the interface section 101, an editing section 103 (judging section) for editing data of one page according to the print data stored in the receiving buffer storage 102 and generating print page information, and a page buffer storage 104 for storing the print page information.

The controller 100 further includes a spreading section 105 for outspreading the print page information stored in the page buffer storage 104 into image data, a raster buffer storage 106 for storing the image data outspreaded by the spreading section 105, a raster data output section 107, and a print control unit 190. The raster data output section 107 is provided for reading out the image data from the raster buffer storage 105 and transmitting the image data to the print executor 200 when getting an inform from the print control unit 190. The print control unit 190 is provided for controlling all parts of the controller 100. At the same time, the print control unit 190 receives a print job from the spreading section 105 and requests the print executor 200 to perform print preparation.

The controller 100 further comprises an operation section 110 (informing section) and a memory location 120. The operation section 110 includes operation panel 111, panel controlling section 112 and display character string storage 113. The operation panel 111 displays state and user's kinds of operations of the printing apparatus 1000. The panel controlling section 112 is provided for controlling the operation panel 111. The display character string storage 113 is a character string database for displaying on the operation panel 111.

The memory location 120 comprises a parameter administration section 121 for administrating amended information in condition that setting of the printing apparatus 1000 is modified through the operation panel 111, a nonvolatile storage 122 for saving the amended information, and a continue print JOB ID storage 123. The continue print JOB ID storage 123 is provided for storing continue print JOB ID information which denotes operation information of continue print mode.

The print control unit 190 has a paper feeding tray selecting section 191. The paper feeding tray selecting section 191 gets print media information from the parameter administration section 121 and continue print JOB ID information from the continue print JOB ID storage 123. The print control unit 190 judges whether the present processing is a continue print task according to the continue print JOB ID information. If the present processing is judged as the continue print task, the paper feeding tray set according to the continue print paper feeding information 52 is selected as a paper feeding tray. If the present processing is determined as a non-continue print task, the print control unit 190 searches the paper feeding trays to find whichever has matched print media information with the upper apparatus and selects the paper feeding tray having matched print media information as the paper feeder.

The print executor 200 comprises an I/F section 201, a state managing section 202, a clock control section 203, an electromotor control section 204, a fixation controller 205, a print media presence/absence monitor 206, a print media feeding monitor 207 and a LED head section 208.

The I/F section 201 is performing for an interface between the controller 100 and print executor 200. The state managing section 202 monitors states of each electromotor, sensor and presence/absence of the print media. The clock control section 203 sends clock pulse to the LED head section 208 according to the start of the state managing section 202. The electromotor control section 204 is provided for controlling paper feeding electromotors 224~227 of the paper feeding trays and a print media shifting electromotor 228. The fixation controller 205 is provided for monitoring state of a temperature sensor 229 and controlling ON/OFF of a heater so as to control temperature of a fixation device. The print media presence/absence monitor 206 is provided for monitoring four print media presence/absence sensors 4~6,12 and sending the print media presence/absence information of each paper feeding tray to the state managing section 202. The print media feeding monitor 207 monitors the feeding state of the print media through a cassette sensor 10, an input sensor 15, a conveyer belt sensor 17, and an output sensor 30. The LED head section 208 generates image on the print media according to raster data from the raster data output section 107.

Figure 2:
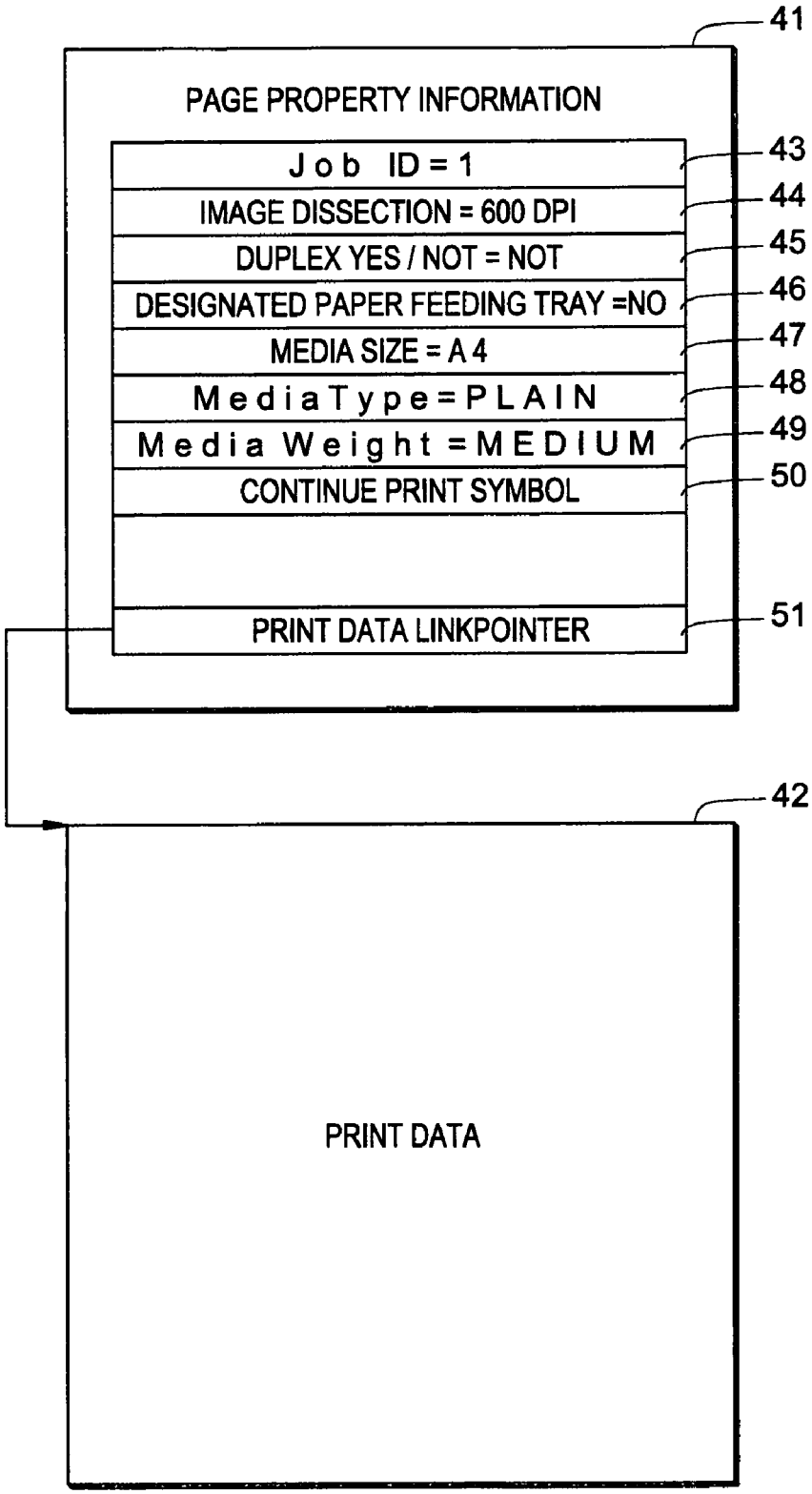
FIG. 2 is a schematic view showing configuration of page information.

Referring to FIG. 2, print page information generated by the editing section 103 includes page property information 41 and print data 42. The page property information 41 includes JOB ID information 43 distributed discretionarily according to task unit, resolution information 44 relating to the print data of the print page, duplex (double-side printing) YES/NOT information 45, paper feeding tray designation information 46 designated by the upper apparatus 300, media size 47, media type 48, media weight 49, continue print symbol 50 in condition that the continue print mode is ON, and print data linkpointer 51 which is denoting actual address stored the print data therein.

The hardware of the digital photo printing apparatus 1000 in the first embodiment is discussed as follows in accordance with FIG. 3. The printing apparatus 1000 includes a plurality of paper feeding trays 1~3 and 13. The paper feeding trays 1~3, 13 respectively defines a print media presence/absence sensor 4~6, 12 therein. Each paper feeding tray 1~3, 13 defines a paper feed roller 7~9,14 therein, respectively. For example, the feed roller 9 conveys print media in the paper feeding tray 1 to a public feeding path 32 via a feeding roller 11.

The public feeding path 32 defines a feeding sensor 15, resist roller 16, feeding belt sensor 17, a plurality of display modules 25~28, fixation roller 29, output sensor 30 and output roller 31. The print media in the four trays 1~3, 13 are conveyed to the public feeding path 32 and are then conveyed to the display sections 25~28 by the resist roller 16. The resist roller 16 is arranged between the feeding sensor 15 and the feeding belt sensor 17. The feeding sensor 15 is provided to adjust the head edge of the feed print media. The feeding belt sensor 17 is provided for controlling startup timing of the display modules so as to detecting feeding status of the print media.

Four display modules 25~28 transfer print color images in turn so as to generate multicolor image. To be specific, the display module 25 prints the image in Cyan (C), the display module 26 prints the image in Magenta (M), the display module 27 prints the image in Yellow (Y), and the display prints the image in Black (K). The paper which has been transfer printed in multicolor (CMYK-colors) orderly through the display modules 25~28 is taken as the print media and is conveyed to the fixation roller 29. The fixation roller 29 prints the multicolor image on the print media after heat fixation. Subsequently, the print media is carried through the output roller 31 to the output port under monitoring by the output sensor 30.

Figure 4:
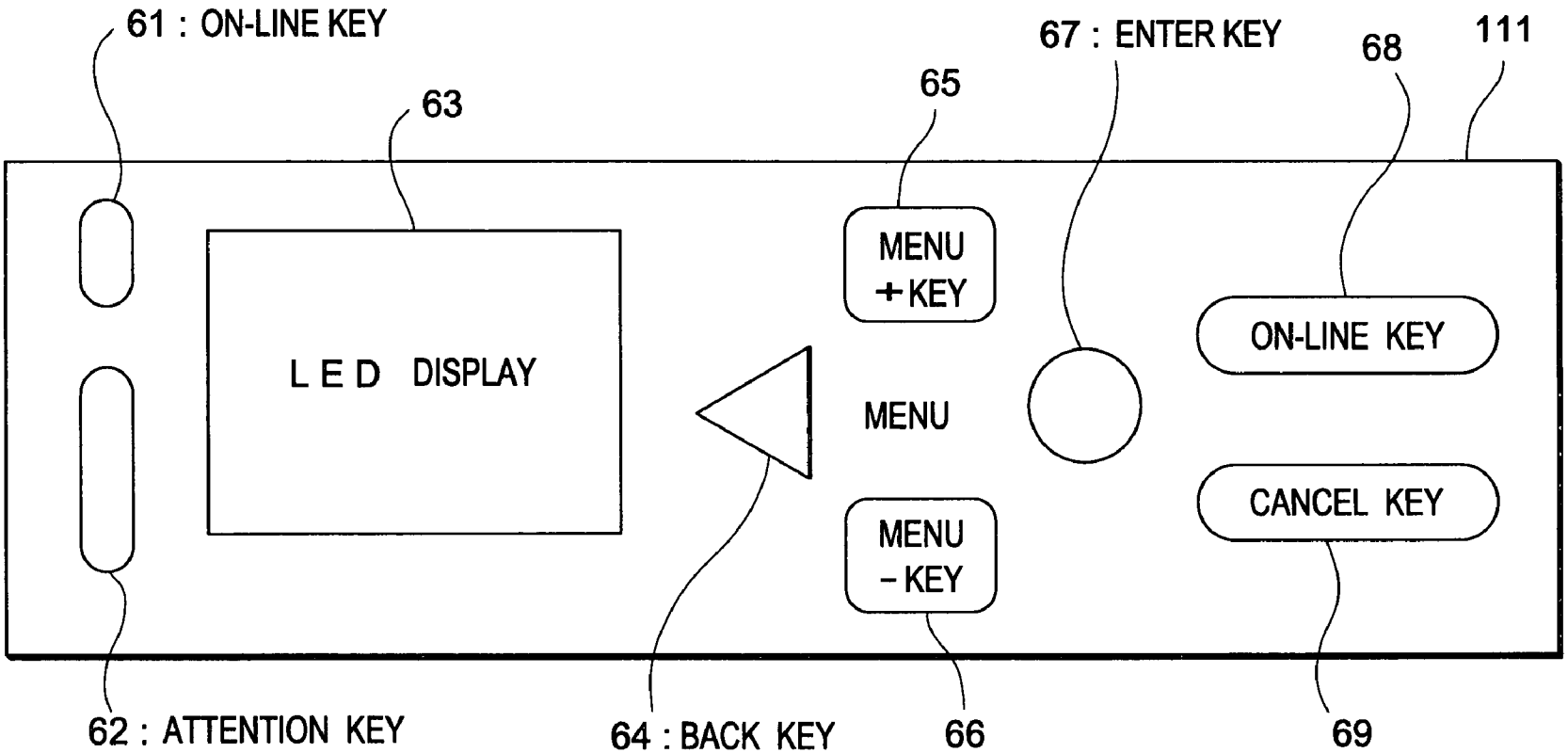
FIG. 4 is a schematic view showing an operation panel of the digital photo printing apparatus in the first embodiment.

FIG. 4 is a schematic view showing an operation panel 111 (print media condition setting input section) of the printing apparatus 1000 in the first embodiment. The operation panel 111 includes ON-LINE lamp 61, ATTENTION lamp 62, LED display 63, BACK key 64, MENU+ key 65, MENU− key 66, ENTER key 67, ON-LINE key 68 and CANCEL key 69.

If the print media designated by the upper apparatus 300 is inconsistent with that in the paper feeding trays of the printing apparatus 1000, a request for whether execute the continue print is displayed on the LED display 63 of the operation panel 111.

If a user wants to continue print and presses the ON-LINE key 68 (continue print key) on the operation panel 111. Once the panel controlling section 112 detects the ON-LINE key 68 is pressed, the panel controlling section 112 sends an information of "continue print request by the user" to the print control unit 190. The print control unit 190 designates the continue print symbol to ON after gets the information.

Figure 3:
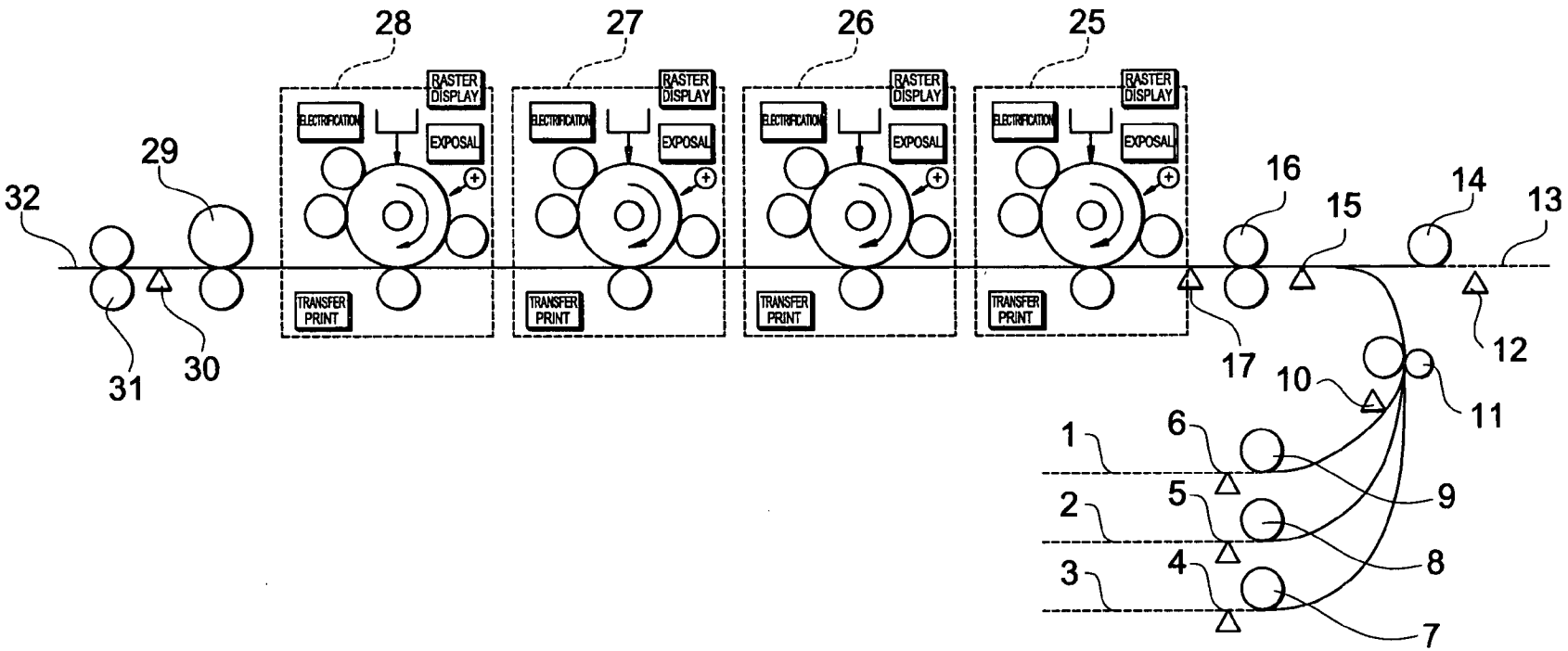
FIG. 3 is a sectional view of the digital photo printing apparatus in the first embodiment.

The paper feeding trays 1~3, 13 shown in FIG. 3 can be set as expected print media through operation above mentioned keys. For example, when the printing apparatus 1000 is online, if the MENU+key 65 is pressed and the print system will enter in a print setting mode (Manual mode), menu of print media information in each paper feeding tray is displayed on the LCD display 63 via operating the MENU+ key 65, MENU− key 66, ENTER key 67 and BACK key 64. The LCD display 63 displays plurality of options to be chosen according to the pressed MENU+ key 65 or MENU− key 68 on the menu. The user can press the ENTER key 67 at the expected option so as to input the setup information.

Description about the setup items of the print media in paper feeding trays is given with reference to FIG. 5. As shown in FIG. 5, three items of the print media can be set respectively. For example, item of paper size can be set from Value column. To be specific, paper size of the print media can be set as A4 (210 mm×297 mm), Letter (215.9 mm×279.4 mm) or Legal 13 (215.9 mm×330.2 mm) etc.

Steps of the digital photo printing apparatus in the first embodiment are described as follows.

First to introduce processes of the controller 100. The print control unit 190 communicates with the I/F section 201 of the print executor 200 when gets the print request from the spreading section 105, and then monitors the state of the print executor 200. If print condition is ready, the print control unit 190 commands the print executor 200 to make preparations for printing and to feed paper for the designated paper feeding tray. When the print control unit 190 finds that the preparations of the print executor 200 are finished, the print control unit 190 inform the print executor 200 to print and command the raster data output section 107 to send raster data. At the same time, the raster data output section 107 reads out the raster data from the raster buffer storage 106 according to line unit and transmits the raster data to the LED head section 208 which is synchronous with clock pulse outputted from the clock control section 203 of the print executor 200.

Now to discuss print processes of the print executor 200. Once the print executor 200 is commanded to prepare for processing by the controller 100, the fixation controller 205 monitors the temperature sensor 229, controls to heat to an appropriate temperature and informs the controller 100 that the preparations are ready. Simultaneously, in order to make the paper feeding tray designated by the controller 100 feed paper, the state managing section 202 commands the electromotor control section 204 to make the paper feeding electromotor of the designated paper feeding tray start so as to perform feeding the print media. Sequentially, when gets an inform that the print media has been conveyed to the input sensor 15 from the electromotor control section 204, the state managing section 202 informs the controller that preparation of feeding paper is ready. Then, when the state managing section 202 receives the print request from the controller 100, the print media shifting electromotor 228 is started, the print media is carried to the display sections 25~28 and is printed corresponding image thereon.

The print media presence/absence monitor 206 monitors the print media presence/absence sensors 4~6, 12. If the paper feeding trays are drawn out or print media is used up in continue print, the print media presence/absence monitor 206 inform the state managing section 202 that the print media is consumed and needs to supply. The state managing section 202 inform the controller 100 of presence/absence of the print media when gets the message from the print media presence/absence monitor 206.

Figure 6:
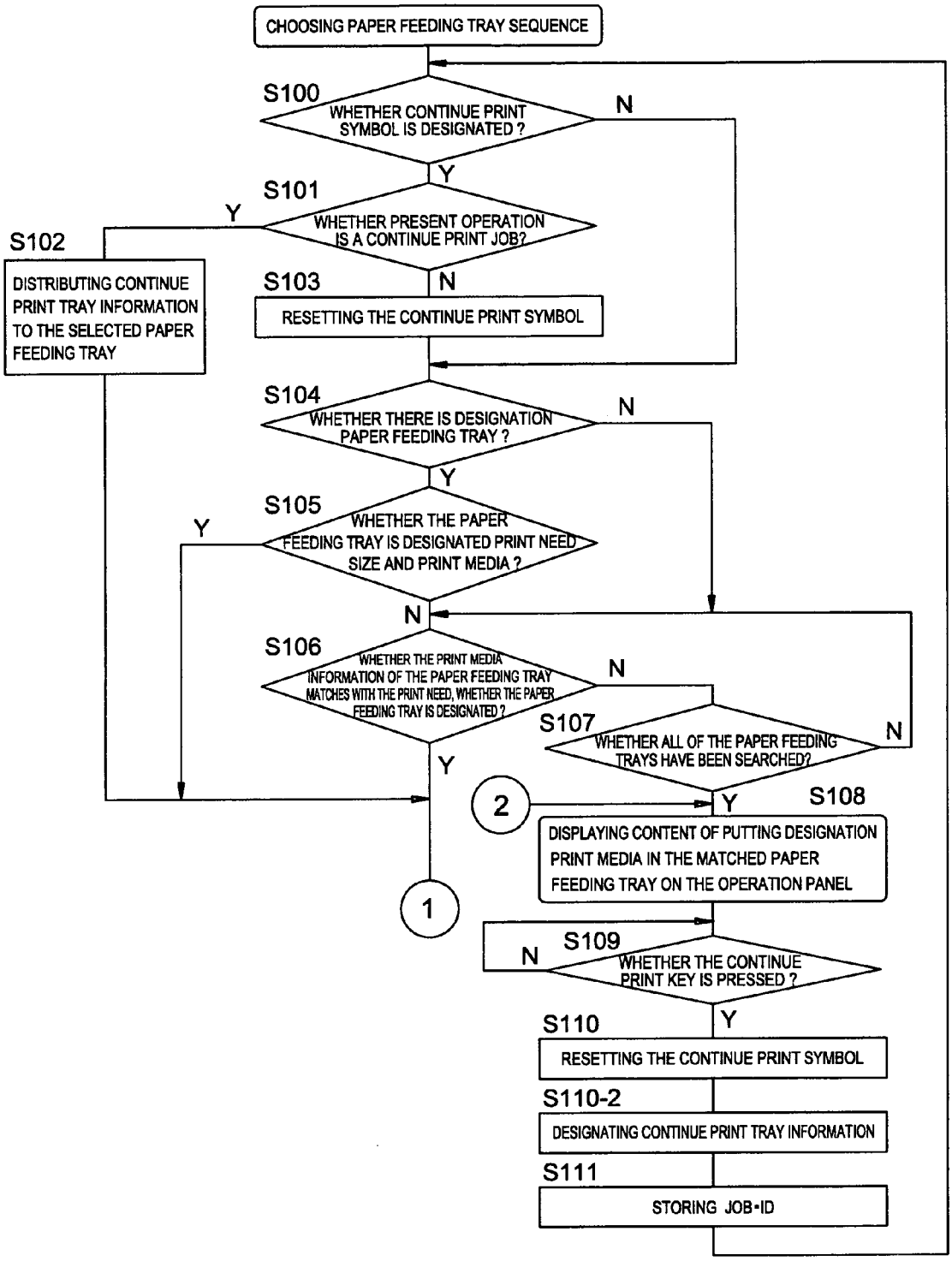
FIG. 6 is a flow chart of selecting paper feeding trays in the first embodiment (part one)
Figure 7:
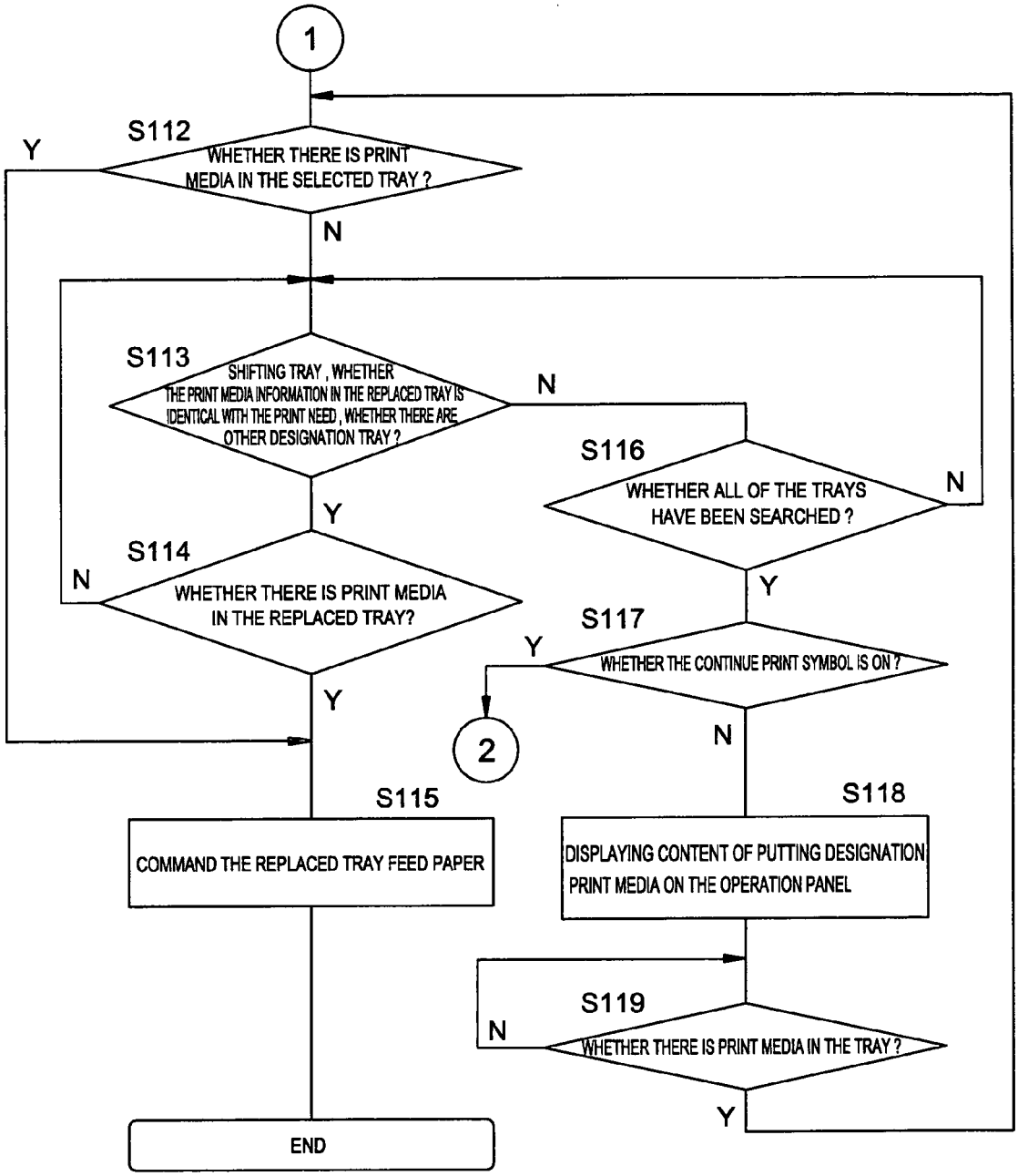
FIG. 7 is a flow chart of selecting paper feeding trays in the first embodiment (part two)

Procedure of designation the paper feeding trays of the print control unit 190 in the first embodiment is discussed as follows with reference to FIGS. 6 and 7. FIG. 6 is a flow chart of a first procedure of selecting paper feeding trays in the first embodiment. FIG. 7 is a flow chart of a second procedure which follows the first procedure.

When the print control unit 190 gets a print request, the print control unit 190 judges whether continue print symbol is designated according to the page property information 41 (Step S100). If the continue print symbol is ON, in order to judge whether the present operation is a continue print job, the print control unit 190 reads out continue print JOB ID from the continue print JOB ID storage 123 and compares with the JOB ID information 43 of the page property information 41 so as to judge whether information of JOB ID are matched (Step S101). If the information of JOB ID are matched, the print control unit 190 judges the present operation as a continue print job and distributes continue print tray information 52 to the selected paper feeding tray (Step S102). If the information of JOB ID are inconsistent, the print control unit 190 judges the present operation as discontinue print job and sets the continue print symbol 50 to OFF (Step S103).

When the continue print symbol 50 is set to OFF, or the continue print symbol 50 in the step S100 is OFF, the print control unit 190 reads out the paper feeding tray designation information 46 from the page property information 41 so as to establish whether there is designation paper feeding tray (Step S104). If the designation paper feeding tray is in existence, the print control unit 190 extracts the print media information of the designation tray from the memory location 120 so as to judge whether the print media information of the designation tray (print media designation information) is consistent with the print media information 47~49 of the page property information 41 (Step S105). In this case, if matched, the print control unit 190 takes the designation tray as the paper feeding tray; if unmatched or there is no designation tray in the step S104, the print control unit 190 extracts the print media information of the next tray to judge whether the print media information matches with the print media information 47~49 of the page property information 41(Step S106). As such, if matched, the print control unit 190 takes the designation tray as the paper feeding tray. If unmatched, the print control unit 190 judges whether all of the register trays have been run through the step S106 (Step S107). If there is any register tray hasn't been checked according to the step S106, run the step S106 with respect to the next tray.

Repeat the step S107, If there is no tray that contains print media setting information matched with the print media information 47~49 of the print property information 41 after search all of the trays, command of displaying the character string, which indicates print media placement request and the paper feeding tray having matched designation print media, is sent to the panel controlling section 112 (Step S108). Subsequently, if the user presses the ON-LINE key 68 (Step S109), the print control unit 190 resets the continue print symbol 50 to ON (Step S110) and stores the information of the paper feeding tray to be put in the print media in the continue print tray information 52 (Step S110-2). The information of JOB ID in the page property information 41 is stored in the continue print JOB ID storage 123 (Step S111). Subsequently, the procedure returns to the step S100.

After select corresponding paper feeding tray to supply paper according to above mentioned procedure, the print control unit 190 performs second procedure shown in FIG. 7. The print control unit 190 judges whether there is print media in the designated paper feeding tray (Step S112). If there are print media in the designated paper feeding tray, the print executor 200 command corresponding paper feeding tray to feed print media (Step S115). And then, the procedure of selection paper feeding tray is over.

If there is no print media in the designated paper feeding tray in the Step S112, the print control unit 190 extracts print media information of the next paper feeding tray and compares it with the print media information 47~49 of the page property information 41 (Step S113). In the step S113, if the print media information is consistent, shift the designated paper feeding tray and judge whether there is print media in the shifted paper feeding tray (Step S114). In the Step S114, if there are print media in the shifted paper tray, command the print executor 200 to feed print media from corresponding paper feeding tray (Step S115). By far, the procedure of selection the paper feeding tray is over. If the print media information is inconsistent in the step S113, the print control unit 190 judges whether all of the register trays have been run through the step S113 (Step S116). If there is any register paper feeding tray hasn't been run through the step S113, perform the step S113 with respect to the next paper feeding tray. Similarly, in the step S114, if there is no print media in the shifted paper feeding tray, repeat the processing of the step S113.

In step S116, if all paper feeding trays has been searched, inspect the continue print symbol 50 of the paper property information 41 (Step S117). Referring to the step S117, if the continue print symbol 50 is OFF, command the panel controlling section 112 to display the character string so as to show the designated paper feeding tray as paper supply tray and request for put in print media according to the print media information of the paper supply tray (S118). After that, wait for an inform of supplying the print media from the print executor 200. Once get the inform, the print control unit 190 returns to the step S112 and commands the print executor 200 to feed print media from corresponding paper feeding tray (Step S115). Subsequently, the procedure of selection paper feeding tray is over.

In the step S117, if the continue print symbol is OFF, turn to the step S108 in FIG. 6 and inform the panel controlling section 112 to display character string of the paper feeding tray which has continue print tray information and has print media information based on the print media information 47~49 of the page property information 41 (Step S108). Subsequently, once the ON-LINE key 68 is pressed (Step S109), repeat processing of steps after the step S110 and instruct the print executor 200 to command the paper feeding tray containing the continue print tray information to feed print media (Step S115). Then the procedure of selection paper feeding tray is over.

As discussed above, the digital photo printing apparatus according to the first embodiment, the print control unit 190 has the paper feeding tray selecting section 191. The paper feeding tray selecting section 191 searches the paper feeding trays to selects tray, which contains print media information matched with the print media information designated by the upper apparatus and the print media information extracted from the memory location 120, as paper supply tray. The selected paper supply tray performs for feeding paper for printing. If there is no paper feeding tray has the matched print media information, send display information to the LCD display 63 so as to indicate a request for putting the designated print media in the designated paper supply tray. Therefore, even no paper feeding tray deposits (i.e. sets) designated print media therein, users can supply the proper print media to the paper supply tray according to the suggestive information on the LCD display 63. Thus, it is easy to shift the paper feeding tray to supply paper so as to realize printing in expected print media.

As disclosed above, if the print media in the designated paper feeding tray is used up, compare the print media of the paper feeding tray to be shifted with the designated print media information specified by the upper apparatus so as do judge whether need to shift paper feeding tray. Thus, it prevents from printing on the unexpected print media.

Second Embodiment

Figure 8:
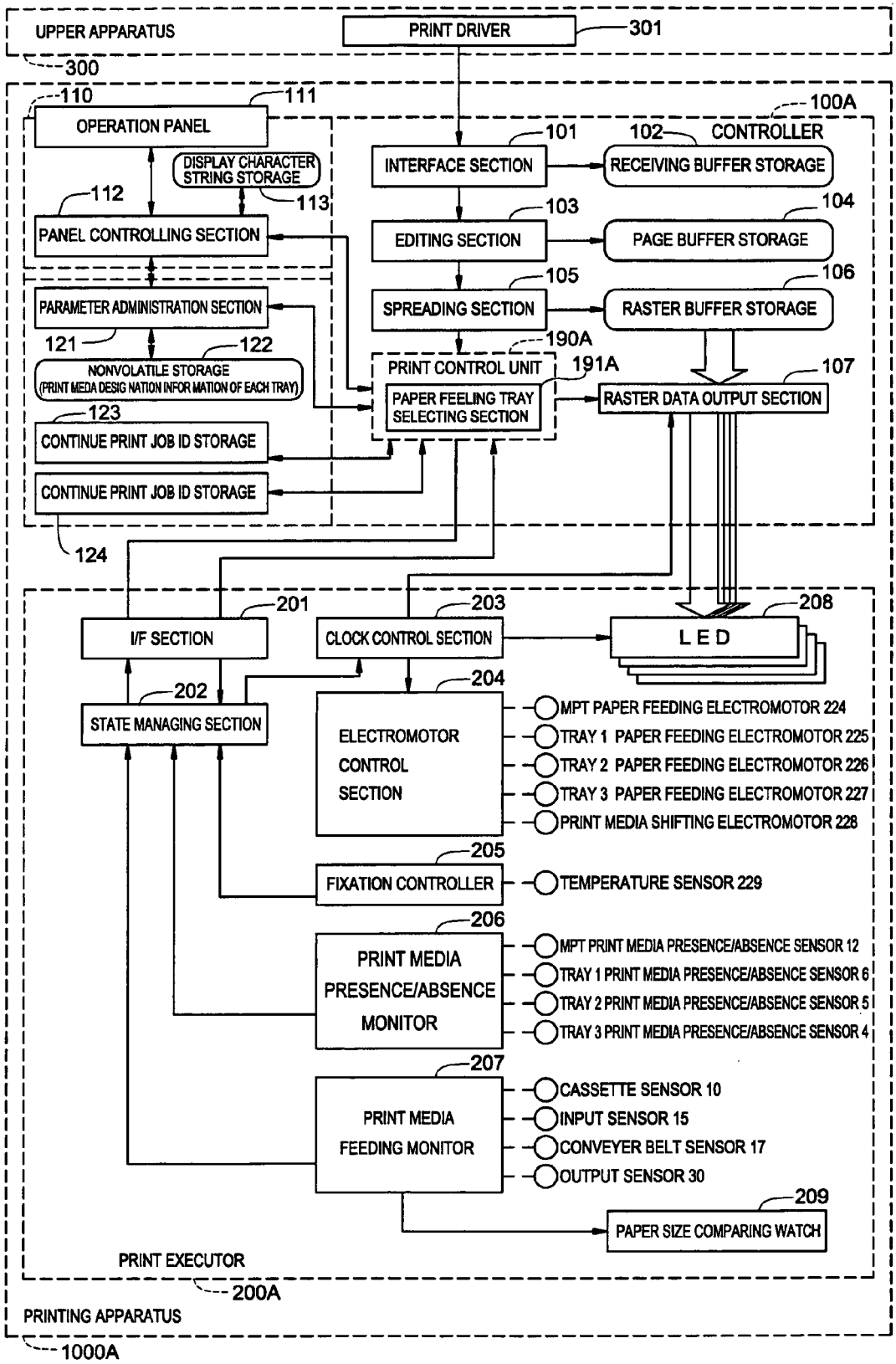
FIG. 8 is a block diagram showing a digital photo printing apparatus according to a second embodiment of the present invention.

As shown in FIG. 8, a digital photo printing apparatus 1000A according to a second embodiment in the present invention is connected to an upper apparatus 300. The printing apparatus comprises a print executor 200A for printing and a controller 100A. The controller 100A controls the print executor 200 according to print data and designated print media information generated from the upper apparatus 300, as will be discussed hereinafter. The controller 100A is connected with the upper apparatus 300 such as a workstation or a PC (Personal Computer). The upper apparatus 300 includes a print driver 301 for transmit the print data to the controller 100A.

The controller 100A comprises an interface section 101 (receiving section) for receiving the print data from the print driver 301, a receiving buffer storage 102 for storing the print data received by the interface section 101, an editing section 103 for editing one print page information, a page buffer storage 104 for storing the one print page information, a spreading section 105 for outspreading the print page information stored in the page buffer storage 104 into image data, a raster buffer storage 106 for storing the image data outspreaded by the spreading section 105, a raster data output section 107, and a print control unit 190A. The raster data output section 107 is provided for reading out the image data from the raster buffer storage 105 and transmitting the image data to the print executor 200 when getting an inform from the print control unit 190. The print control unit 190A is provided for controlling all parts of the controller 100A. At the same time, the print control unit 190 receives a print job from the spreading section 105 and requests the print executor 200A to perform print preparation.

The controller 100A further comprises an operation section 110 and a memory location 120A. The operation section 110 includes operation panel 111, panel controlling section 112 and display character string storage 113. The operation panel 111 displays state and user's kinds of operations of the printing apparatus 1000. The panel controlling section 112 is provided for controlling the operation panel 111. The display character string storage 113 is a character string database for displaying on the operation panel 111.

The memory location 120A comprises a parameter administration section 121 for administrating amended information in condition that definition of the printing apparatus 1000A is modified through the operation panel 111, a nonvolatile storage 122 for saving the amended information, a continue print JOB ID storage 123 and a print media continue print information storage 124. The continue print JOB ID storage 123 is provided for storing continue print JOB ID information which denotes operation information of continue print mode. The print media continue print information storage 124 stores print media information which can be detected by the print executor 200A when the printing apparatus 1000A performs continue print job.

The print control unit 190A has a paper feeding tray selecting section 191A. The paper feeding tray selecting section 191A gets print media information of each paper feeding tray from the parameter administration section 121, obtains continue print JOB ID information from the continue print JOB ID storage 123 and gets print media information of continue print mode from the print media continue print information storage 124. The print control unit 190A judges whether the present processing is a continue print task according to the continue print JOB ID information. If the present processing is judged as the continue print task, the paper feeding tray set according to the continue print paper feeding information 52 is selected as a paper supply tray. If the present processing is determined as a discontinue print task, the print control unit 190A searches the paper feeding trays to find whichever has the matched print media information with the upper apparatus, and further searches the paper feeding trays to find whichever has the matched print media information with the print media continue and selects the paper feeding tray with matched print media information as the paper supply tray.

The print executor 200A comprises an I/F section 201, a state managing section 202, a clock control section 203, an electromotor control section 204, a fixation controller 205, a print media presence/absence monitor 206, a print media feeding monitor 207, a LED head section 208, and a paper size comparing watch 209.

Referring to FIG. 9, the paper size comparing watch 209 is used for designating print media according to the continue printing processing. The paper size comparing watch 209 includes size of the print media, discriminant parameters of the print media such as maximal size, minimal size and ID information distributed by each print media.

The print media feeding monitor 207 transforms data from the pulse counter into the data with mm unit, and then compares it with the scope between the maximal size and the minimal size in the paper size comparing watch 209. The state managing section 202 send the comparison result from the print media feeding monitor 207 to the print control unit 190A of the controller 100A via the I/F section 201.

It should be noted that following terms in the second embodiment are different to the first embodiment. In the second embodiment, the controller 100A has the print media continue print information storage 124 which stores the print media continue print information. When the printing apparatus performs the continue print task, the print executor 200A can detect the print media continue print information. The executor 200A includes the paper size comparing watch 209 used for judging print media according to continue print processing.

Different processes of the printing apparatus between the second embodiment and the first embodiment consists in follow terms. If there is no continue print displaying, the print executor 200A detects the print media information of the paper feeding tray which is set according to the continue print tray information 52. Subsequently, when the print media in above mentioned paper feeding tray are consumed, the print executor 200A shifts paper feeding tray according to the detected print media information and the print media information of each paper feeding tray. Procedure of selection paper feeding tray in the second embodiment which is different to that in the first embodiment and the supplemental print media size detecting processing in the second embodiment are described detailedly as follows.

Figure 10:
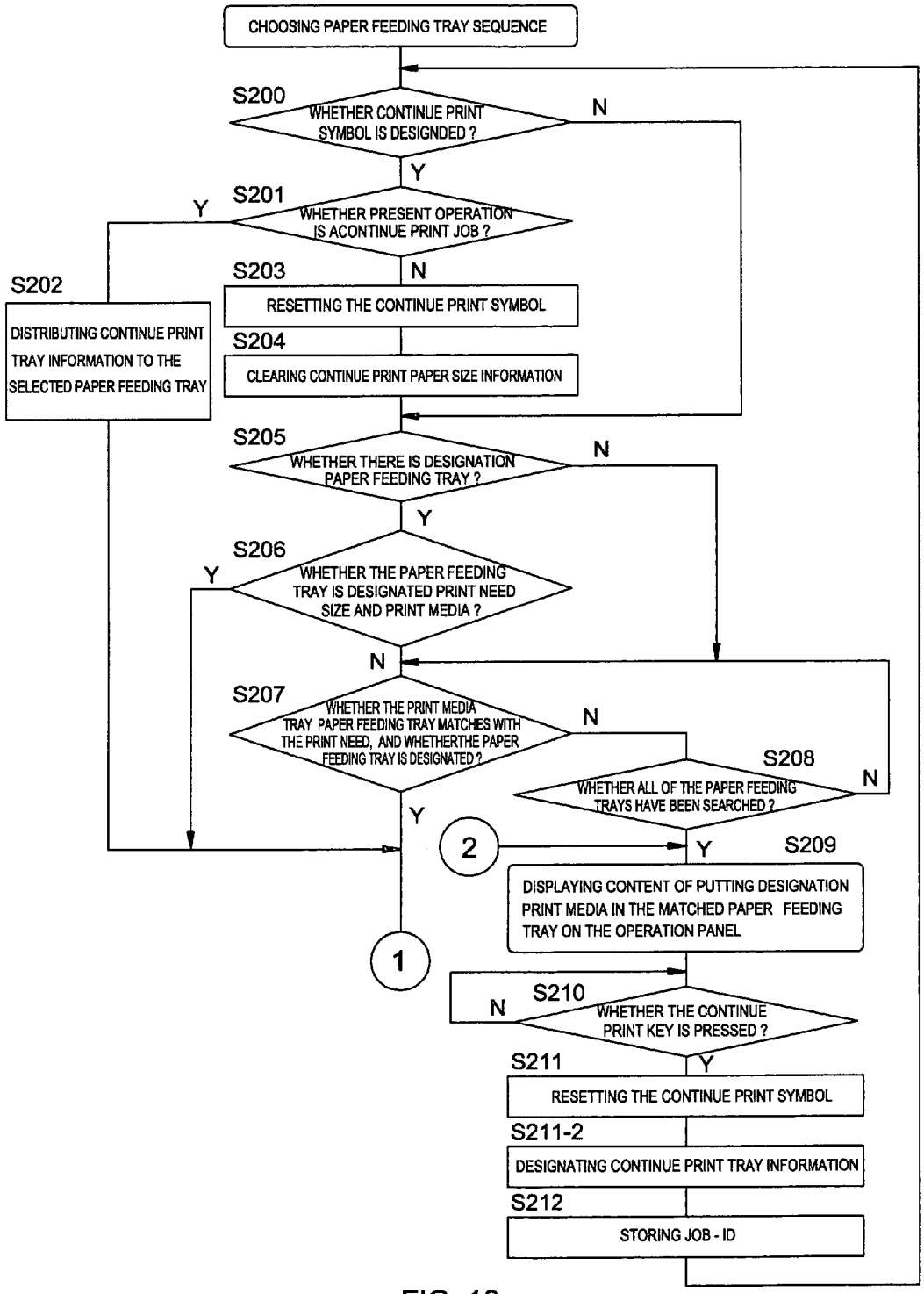
FIG. 10 is a flow chart of selecting paper feeding trays in the second embodiment (part one)
Figure 11:
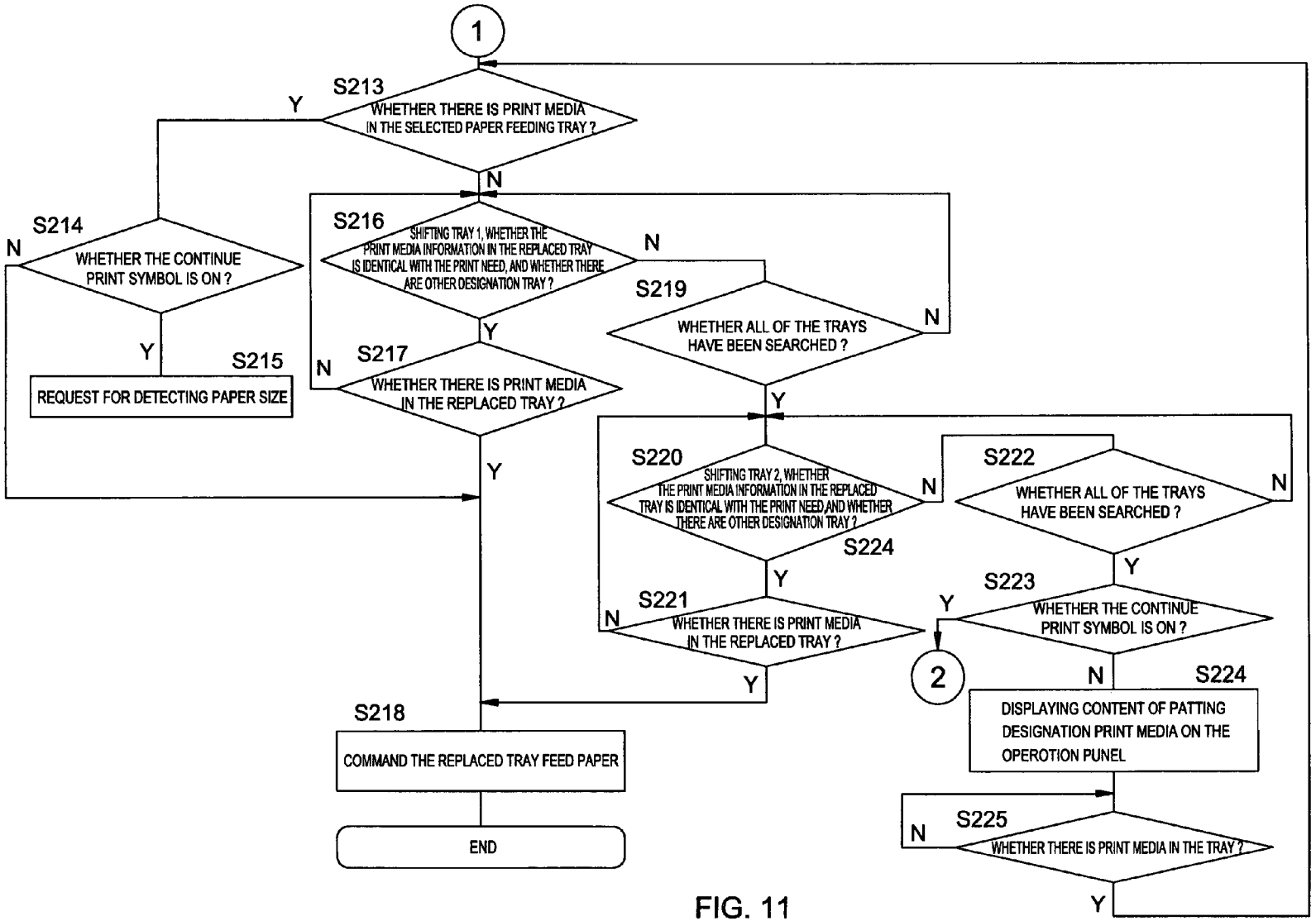
FIG. 11 is a flow chart of selecting paper feeding trays in the second embodiment (part two)

FIGS. 10 and 11 show a flow chart of selecting paper feeding trays by the print control unit 190A in the second embodiment. FIG. 10 is a flow chart about processing of selection paper feeding trays. FIG. 11 shows a flow chart of shifting paper supply tray in the case that there is no print media in the selected paper feeding tray in FIG. 10.

Procedure of FIG. 11 emphasizes on determinant sequence of the paper feeding trays. The difference between the second and first embodiments consists in appending steps S220~S222 to the second embodiment, which will be discussed more detailedly as follows.

Referring to FIG. 11, the control unit 190A judges whether there are print media in the paper feeding tray designated processing of FIG. 10 (Step S213). If there are print media in the designated paper feeding tray in the step S213, the control unit 190A detecting the continue print symbol 50 (Step S2147). When the continue print symbol is ON, the print control unit 190A informs the print executor 200A to detect size of the print media (Step S215). Since the step S215 or the continue print symbol is OFF in the step S214, the print control unit 190A commands the print executor 200A to supply paper from the designated paper feeding tray (Step S218). Subsequently, the print control unit 190A finishes searching the paper feeding tray.

If there is no print media in the designated paper feeding tray in the step S213, the print control unit 190A searches all paper feeding trays registered for being utilized according to the step S216 through step S219. If there is no paper feeding tray that has print media information matched with the print media information 47~49 of the page property information 41, or there is no print media in the matched paper feeding tray, the print control unit 190A extracts the print media information of the paper feeding tray again, which will detected by the print executor in processing of FIG. 12, as will be discussed hereinafter. The print executor 200A judges whether the displayed print media size in the print media continue print information stored in the print media continue print information storage 124 of the controller 100A matches with the print media information 47~49 in the page property information (Step S220).

If the print media information is matched in the step S220, the control unit 190A detect whether there is print media (Step S221). If there are print media in the step 221, the print control unit 190A commands the print executor 200A to supply paper from the designated paper feeding tray (Step S218). If the print media information is unmatched in the step S220, the control unit 190A checks whether all of the paper feeding trays registered for utilized have been executed by step S220 (S222). If not all of paper feeding trays haven't been executed according to step S220, the next paper feeding tray is executed according to the step S220. If there is no print media in the step S221, repeat to execute the step S220.

In the step S222, if all of the paper feeding trays were checked, similarly to the first embodiment, proper print media should be put in the designated paper feeding tray and the printing apparatus continue processing from the step S223. The print control unit 190A commands the print executor 200A to supply paper from the designated paper feeding tray (Step S218) and finishes search the paper feeding tray.

Figure 12:
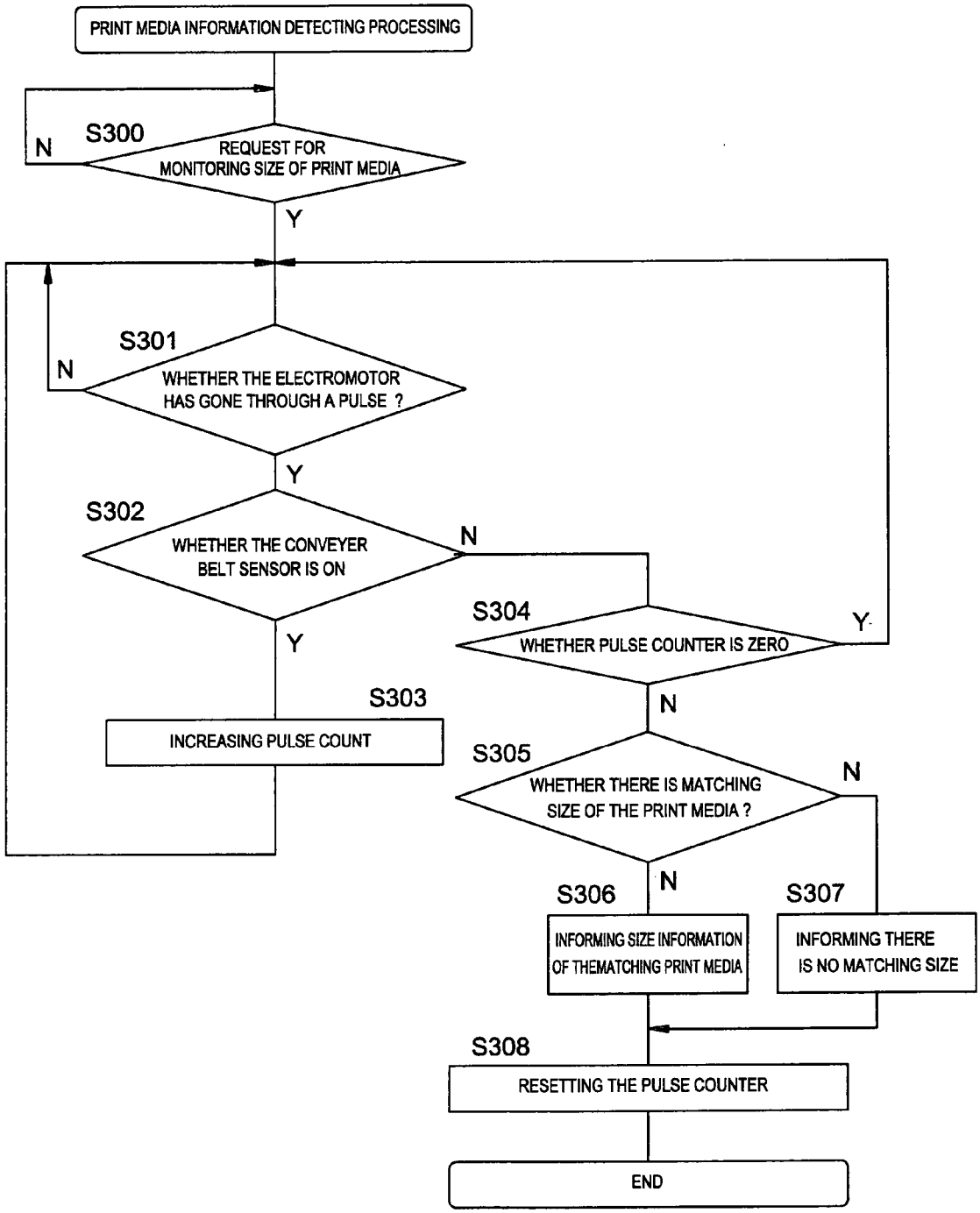
FIG. 12 is a flow chart of detecting print media information in the second embodiment.

FIG. 12 is a flow chart of detecting print media size by the print media feeding monitor 207 in the second embodiment.

The print media feeding monitor 207 is provided for monitoring a request of detecting print media from the controller 100A (Step S300). If there is a request of detecting print media, the print media feeding monitor 207 monitors whether the print media shifting electromotor 228 has gone through a pulse (Step S301). Once the print media shifting electromotor has gone a pulse, the print media feeding monitor 207 monitors the state of the conveyer belt sensor 22 (Step S302). If the conveyer belt sensor 22 is ON, the pulse counter of the inter work area increases pulse count (Step S303).

Repeat processing from the step S301 to the step S303. In the step S302, if the conveyer belt sensor 22 is OFF, the print media feeding monitor 207 judges whether pulse count of the pulse counter in the inter work area is zero (Step S304). If the pulse count is zero, the print media feeding monitor 207 transforms data in the pulse counter into data with mm unit and compares it with the scope between maximal size and minimal size in the paper size comparing watch 209 (Step S305). If there are matching pint media in the paper size comparing watch 209, inform the controller 100A of size of the matching print media (Step S306), while if there is no matching print media in the paper size comparing watch 209, inform the controller 100A of size ID of the matched pint media. Subsequently, reset the pulse counter (Step S308) and end the print media detecting processing.

As disclosed above, according to the second embodiment, when there is no print media in continue print mode, further there is no paper feeding tray that contains print media matching with the designated print media designated by the upper apparatus, the printing apparatus searches the matched paper feeding tray according to the detected print media information. Thus, the printing apparatus can print in the expected print media.

Furthermore, in the second embodiment, when executes continue print processing, the printing apparatus searches matching paper feeding tray only under the matching condition of print media size. However, if the printing apparatus includes auto paper thickness detector, paper thickness can also be taken as searching condition and used in searching matching paper feeding tray processing.

What is claimed is:

1. An image forming apparatus having a plurality of trays for accommodating a plurality of different types of print media, which comprises:

a receiving section for receiving print data from an upper apparatus;

a storing section for storing first print media designation information included in the print data received from the upper apparatus;

a judging section for judging whether or not first print media is accommodated in the plurality of trays, the first print media being print media that corresponds to the first print media designation information;

an informing section which, if at least one of the trays accommodates the first print media at the beginning of a print job but the first print media is used up before completion of the print job, issues a first print media replacement request to request an operator to replenish the first print media, and which if none of the plurality of trays accommodates the first print media at the beginning of the print job, issues a first print media placement request to request the operator to place first print media in one of the plurality of trays in which second print media is accommodated, the second print media being different from the first print media; and a controller which, after issuance of the first print media placement request, executes an image forming process on the basis of the print data by using the second print media in said one of the trays if the operator inputs a continue printing instruction and, if the operator does not input the continue printing instruction but instead loads arbitrary print media into said one of the trays, executes the image forming process using the arbitrary print media;

wherein the informing section, if the operator inputted the continue printing instruction after issuance of the first print media placement request and if the second print media in said one of the trays is subsequently used up, issues a second print media placement request to request the operator to place second print media in said one of the trays, and wherein the controller, if second print media is placed in said one of the trays after issuance of the second print media placement request, continues the image forming process on the basis of the print data by using the second print media.

2. The image forming apparatus according to claim 1, further comprising a print media identifying section for identifying the type of print media held by each tray, and a tray selecting section for selecting a proper paper feeding tray from the plurality of trays.

3. The image forming apparatus according to claim 2, further comprising:

a sensor for sensing whether said one of the trays is loaded with the second print media; and a continue print tray information storing section for storing information detected by the sensor as detected print media information.

4. The image forming apparatus according to claim 2, wherein the print media identifying section includes a memory section for storing print media identifying information with respect to each tray.

5. The image forming apparatus according to claim 2, wherein the print media identifying section includes a detecting section for detecting length of the print media feed by each tray so as to identify print media according to the length information from the detecting section.

6. The image forming apparatus according to claim 1, wherein the image forming section includes a display unit that displays a continue print indicator if none of the trays accommodates the first print media before the print job begins and if the operator inputs a continue printing instruction after the first print media replacement request.

7. The image forming apparatus according to claim 6, wherein the continue print indicator is a continue print symbol.

* * * * *